US011982178B2

(12) United States Patent
Alluhaydan

(10) Patent No.: US 11,982,178 B2
(45) Date of Patent: May 14, 2024

(54) NESTED TUBULARS FOR DRIFTING A PLURALITY OF CYLINDRICAL DIAMETERS

(71) Applicant: SAUDI ARABIAN OIL COMPANY, Dhahran (SA)

(72) Inventor: Abdulaziz Sulaiman Alluhaydan, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 59 days.

(21) Appl. No.: 17/707,168

(22) Filed: Mar. 29, 2022

(65) Prior Publication Data

US 2023/0313675 A1 Oct. 5, 2023

(51) Int. Cl.
*E21B 47/08* (2012.01)
*E21B 31/107* (2006.01)
*E21B 31/12* (2006.01)

(52) U.S. Cl.
CPC ..... *E21B 47/08* (2013.01); *E21B 31/107* (2013.01); *E21B 31/12* (2013.01)

(58) Field of Classification Search
CPC ..... E21B 47/08
See application file for complete search history.

(56) References Cited

U.S. PATENT DOCUMENTS 1,344,619 A 6/1920 Colvin
3,051,239 A 8/1962 Dollison
3,638,723 A 2/1972 Carroll
3,919,759 A 11/1975 Marleau
4,044,470 A * 8/1977 Dufrene ..... E21B 47/09 166/64
4,928,761 A 5/1990 Gazda et al.
6,702,010 B2 * 3/2004 Yuratich ..... E21B 47/01 166/241.5
6,915,855 B2 7/2005 Steele et al.
8,800,650 B2 8/2014 Spray et al.
10,081,998 B2 9/2018 Tunget
11,098,554 B2 8/2021 Brown
2010/0263441 A1 * 10/2010 Gillan ..... E21B 47/08 29/428
2018/0003027 A1 * 1/2018 Donzier ..... E21B 47/10
2018/0172418 A1 * 6/2018 Ohmer ..... G01B 3/26
2020/0109974 A1 * 4/2020 Hill, III ..... G01N 11/08
2021/0215469 A1 * 7/2021 Bomersbach ..... G01B 5/12

* cited by examiner

*Primary Examiner* — Christopher J Sebesta
(74) *Attorney, Agent, or Firm* — Osha Bergman Watanabe & Burton LLP

(57) ABSTRACT

Apparatus and methods for drifting a plurality of cylindrical diameters are disclosed. The apparatus includes a first tubular with a first inner diameter and a first outer diameter. The apparatus further includes a second tubular with a second inner diameter and a second outer diameter, wherein the second outer diameter is smaller than the first inner diameter. The apparatus still further includes a first plurality of attachments that couples the first inner diameter of the first tubular and the second outer diameter of the second tubular, wherein the first plurality of attachments is removeable to allow the second tubular to translate along an axis relative to the first tubular.

16 Claims, 4 Drawing Sheets

NESTED TUBULARS FOR DRIFTING A PLURALITY OF CYLINDRICAL DIAMETERS

BACKGROUND

In the oil and gas industry, the inner diameter of cylinders, such as tubulars and uncased wellbores, is crucial to efficiently transport gases and fluids between the surface and reservoirs. Examples include producing water, brine, and/or hydrocarbons from a hydrocarbon reservoir to the surface, injecting water and/or gas from the surface into a hydrocarbon reservoir, and producing water from a water reservoir to the surface.

Inner diameter verification of cylinders may be performed by drifting. Drifting is defined as the pulling or pushing of a gauge through a cylinder. Drifting may be performed prior to the installation or use of tubulars within a wellbore to ensure the tubulars meet predefined tolerances as specified by the manufacturer. Drifting may also be performed following the installation of tubulars within a wellbore or within an uncased wellbore to ensure the cylinders maintain their inner diameter and are free of debris such as loose sediment and dried cement. If an inner diameter of a cylinder is outside of a predefined tolerance and/or debris exists within a cylinder, wellbore tools, such as drilling tools and logging tools, may become stuck within the wellbore downhole.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to an apparatus for drifting a plurality of cylindrical diameters. The apparatus includes a first tubular with a first inner diameter and a first outer diameter. The apparatus further includes a second tubular with a second inner diameter and a second outer diameter, wherein the second outer diameter is smaller than the first inner diameter. The apparatus still further includes a first plurality of attachments that couples the first inner diameter of the first tubular and the second outer diameter of the second tubular, wherein the first plurality of attachments is removeable to allow the second tubular to translate along an axis relative to the first tubular.

In general, in one aspect, embodiments relate to a method of drifting an apparatus for a plurality of cylindrical diameters, wherein the apparatus has a first tubular, a second tubular, and a first plurality of attachments that couples a first inner diameter of the first tubular and a second outer diameter of the second tubular. The method includes translating the apparatus through a first diameter within the plurality of cylindrical diameters along an axis until the first tubular contacts a first floor. The method further includes removing the first plurality of attachments. The method still further includes translating the second tubular through a second diameter within the plurality of cylindrical diameters along the axis until the second tubular contacts a second floor.

In general, in one aspect, embodiments relate to a method of retrieving a first tubular. The method includes translating a fishing tool through a first diameter along an axis until the fishing tool engages with a first fishing neck on the first tubular. The method further includes translating the fishing tool coupled to the first tubular along the axis.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
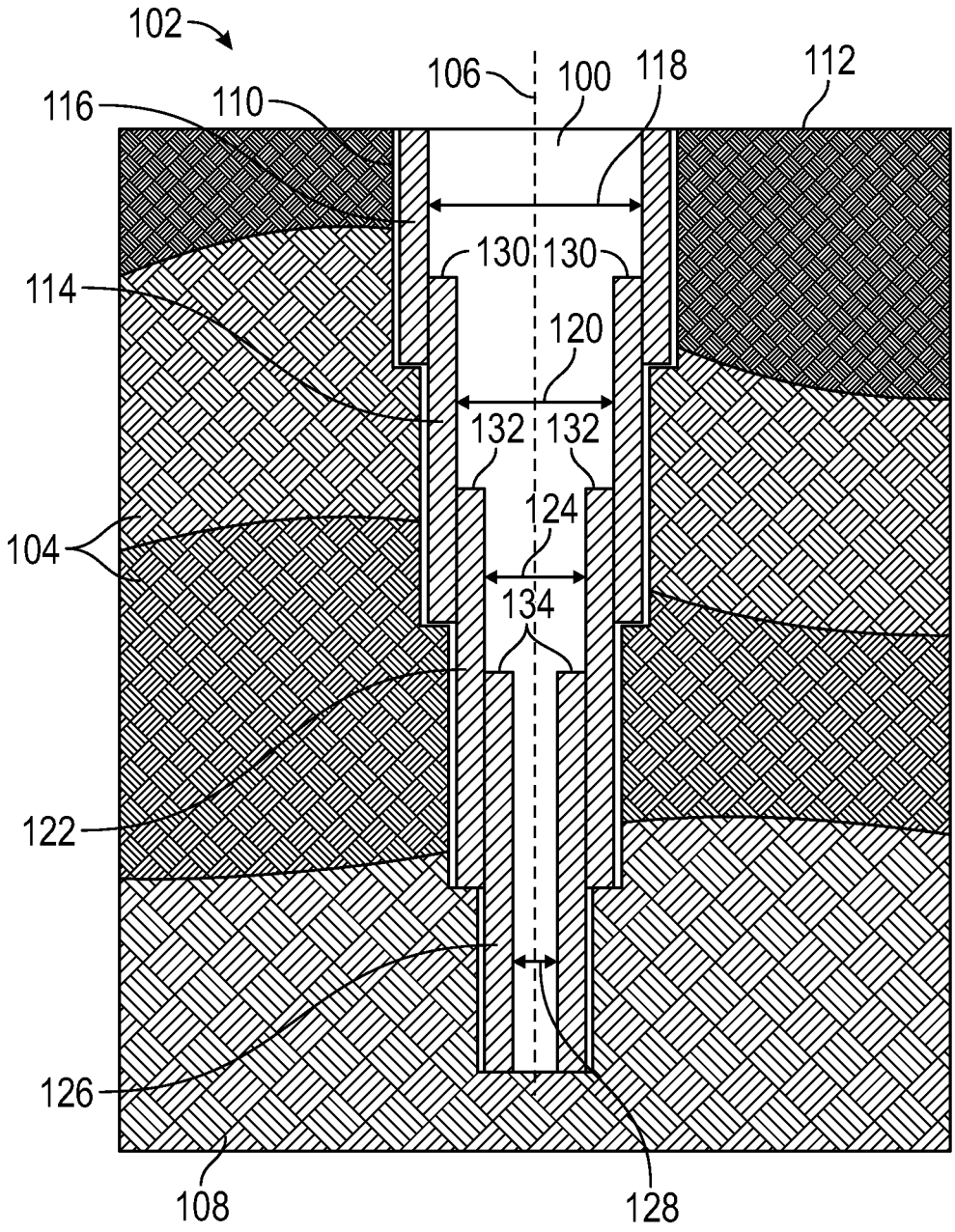
FIG. 1 depicts a wellbore in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "a tubular" includes reference to one or more of such tubulars.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to one of ordinary skill that the subject matter of the dependent claims of one or more embodiments may be combined with other dependent claims.

In the following description of FIGS. 1-5, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Ensuring the inner diameter of cylinders, such as tubulars and uncased wellbores, is critical to efficiently transport gases and fluids between the surface and reservoirs. Examples include producing water, brine, and/or hydrocarbons from a hydrocarbon reservoir to the surface, injecting water and/or gas (i.e., $CO_2$ and $H_2$) from the surface into a hydrocarbon reservoir, and producing water from a water reservoir to the surface. Further, ensuring the inner diameter of cylinders is critical for translating wellbore tools, such as drilling tools and logging tools, along a cased or uncased wellbore.

The inner diameter of cylinders may be verified by drifting. Drifting may be performed prior to the installation or use of tubulars within a wellbore to ensure the tubulars meet predefined tolerances as specified by the manufacturer. Drifting may also be performed following the installation, including make up (i.e., tubular coupling using torquing operations), of tubulars within a wellbore or within an uncased wellbore to ensure the cylinders maintain their inner diameter and are free of debris such as loose sediment and dried cement. Drifting cylinders of multiple inner diameters may be labor intensive and time consuming. For example, a drifting gauge may be lowered into a wellbore, drifted for a cylinder of one diameter, and lifted out of the wellbore. This process may be repeated for each diameter of a cylinder. The present disclosure describes an apparatus for drifting multiple inner diameters of cylinders in series.

FIG. 1 depicts a wellbore (100) within a subterranean region (102) in accordance with one or more embodiments. The wellbore (100) traverses a plurality of rock formations (104) along an axis (106) to ultimately penetrate a hydrocarbon reservoir (108). The plurality of rock formations (104) may include a cap rock formation (104) or the hydrocarbon reservoir (108) may itself be a rock formation (104). In other embodiments, the hydrocarbon reservoir (108) may be a water reservoir. Casing strings and casing liners may be lowered into the wellbore (100) and cemented in place within an annulus (110). Casing strings are composed of casing joints and couplings, where each casing joint is a steel pipe approximately 40 feet long. Casing joints and couplings are threaded together to form a casing string. The casing string is a suitable length for a specific wellbore (100) such that the casing string extends to the top of the wellbore (100) on the surface of the Earth (112).

Casing liners are also composed of casing joints and couplings threaded together but do not extend to the top of the wellbore (100). Instead, casing liners are anchored from inside the adjacent casing liner or casing string closest to the surface of the Earth (112). For example, the surface casing liner (114) in FIG. 1 is anchored from inside the conductor casing string (116). Casing strings and casing liners are collectively referred to hereinafter also as "casing". Casing strings and casing liners are also part of a generic class called "tubulars" and, even more generic, "cylinders". Tubulars are defined as any pipe-like element used in the oil and gas industry. A tubular may have both an inner diameter and an outer diameter. Cylinders are defined as any cylindrical-like object in the oil and gas industry, such as tubulars and uncased wellbores (100). Cylinders may have only one diameter.

Once casing is installed within a wellbore (100), casing may provide wellbore strength and stability such that neighboring rock formations (104) do not cave into the wellbore (100) and wellhead tools may be installed on the surface of the Earth (112). Further, casing may isolate one rock formation (104) from a neighboring rock formation (104) and/or the wellbore (100). Further still, casing may aid in the control of pressure and fluid flow within the wellbore (100) during the production of hydrocarbons from the hydrocarbon reservoir (108) and during the injection of water and/or gas into the hydrocarbon reservoir (108). Following casing of the wellbore (100), the wellbore (100) may present a plurality of cylindrical diameters in some embodiments. In other embodiments, the wellbore (100) may remain uncased and still present a plurality of cylindrical diameters. Returning to the cased wellbore (100) embodiment in FIG. 1, the conductor casing string (116) may present a first diameter (118) within the plurality of cylindrical diameters. The surface casing liner (114) may present a second diameter (120). The intermediate casing liner (122) may present a third diameter (124) and the production casing liner (126) may present a fourth diameter (128).

Because a casing liner may be anchored from inside an adjacent casing string or casing liner, the plurality of cylindrical diameters may diminish as the wellbore (100) traverses the plurality of rock formations (104). For example, the first diameter (118) may be the largest diameter; the second diameter (120), the second largest diameter; the third diameter (124), the third largest diameter; and the fourth diameter (128), the smallest diameter. Further, because a casing liner may be anchored from inside an adjacent casing string or casing liner, the wellbore (100) may present one or more floors at a casing liner-casing string interface or casing liner-casing liner interface. For example, the interface between the conductor casing string (116) and the surface casing liner (114) creates a first floor (130) as shown in FIG. 1. The interface between the surface casing liner (114) and the intermediate casing liner (122) creates a second floor (132). The interface between the intermediate casing liner (122) and the production casing liner (126) creates a third floor (134).

It may be advantageous to verify the dimensions of the plurality of cylindrical diameters by drifting. Drifting is defined as the pulling or pushing of a gauge (colloquially referred to as a "rabbit") through a cylinder to verify the diameter of the cylinder. Hereinafter, the term "cylindrical diameter" will be used to describe the diameter to be drifted. The cylindrical diameter may be the inner diameter of a tubular or the only diameter of a cylinder. A plurality of cylindrical diameters is referenced separately as a "first diameter", "second diameter", etc.

Drifting may be performed for tubulars prior to the tubulars being installed into a wellbore (100) to ensure the tubulars meet the predefined tolerance specified by the manufacturer. Drifting may also be performed following installation of a tubular into a cylinder and/or for the cylinder itself to ensure the tubular and/or cylinder maintains its cylindrical diameter and is free of debris such as loose sediment and dried cement. If a cylindrical diameter of a cylinder is outside of a predefined tolerance and/or debris exists within a cylinder, wellbore tools, such as drilling tools and logging tools, may become stuck within the wellbore (100) downhole. Further, if a plurality of cylindrical diameters to be drifted is present, it may be laborious to drift each diameter with a separate gauge. Specifically, in some embodiments, a gauge may need to be lowered into a wellbore (100), used to drift the appropriate diameter, and lifted out of the wellbore (100) for each diameter to be drifted.

Figure 2B:
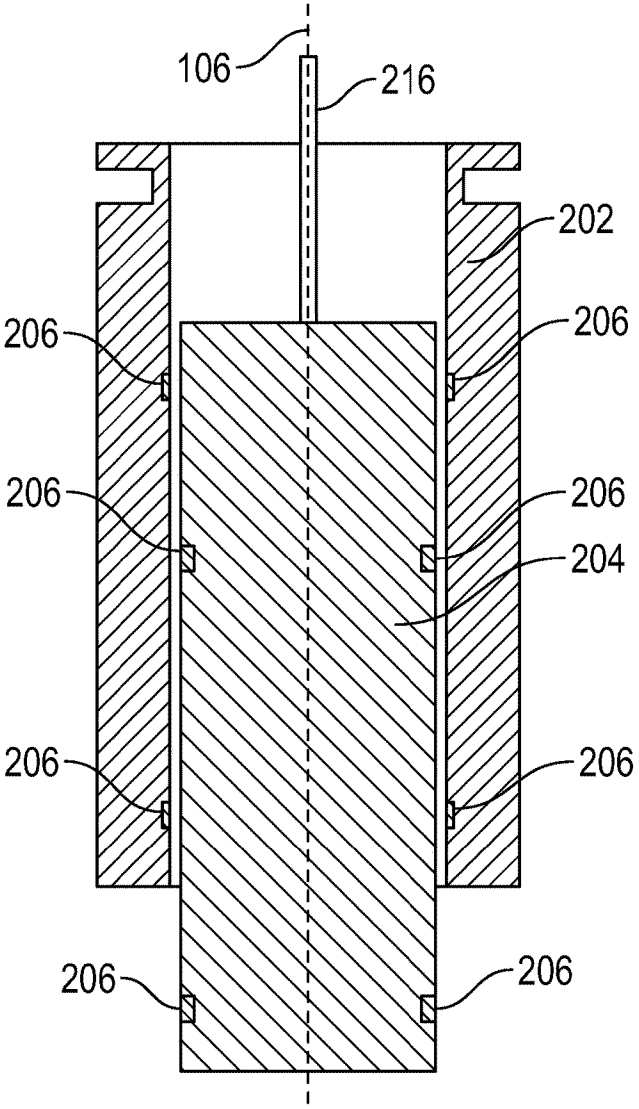
FIG. 2B shows a side view of a partially expanded apparatus in accordance with one or more embodiments.
Figure 2A:
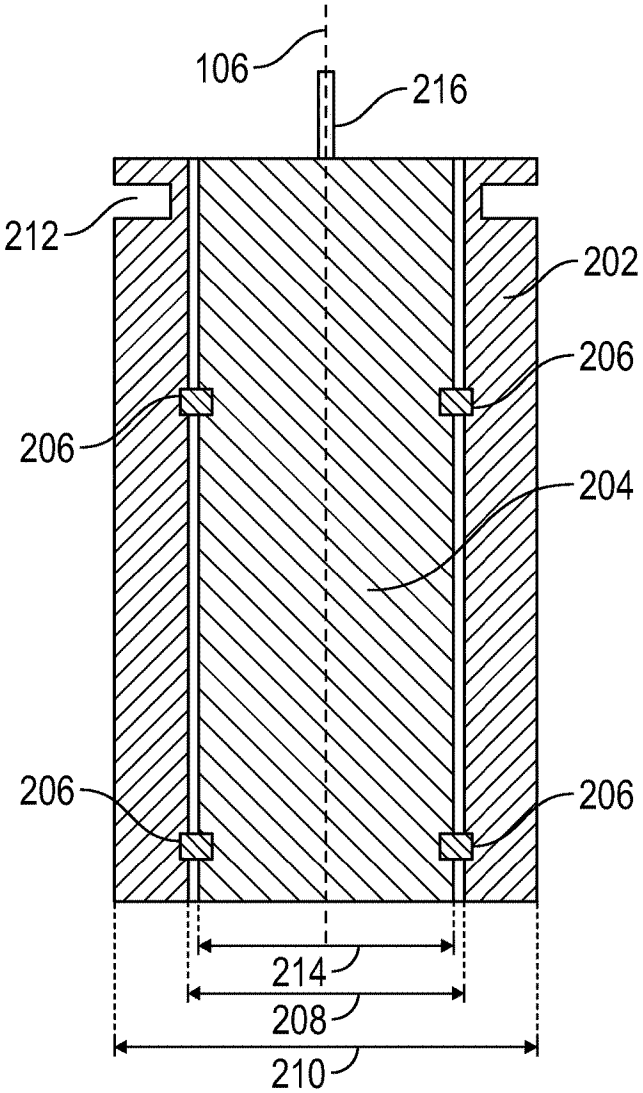
FIG. 2A shows a side view of a fully nested apparatus in accordance with one or more embodiments.

FIG. 2A shows a side view of an apparatus for drifting two cylindrical diameters in accordance with one or more embodiments. The apparatus allows for two cylindrical diameters to be drifted in series. During drifting, the apparatus, at least in part, is translated through the cylinders only once. The apparatus includes a first tubular (202), a second tubular (204), and a first plurality of attachments (206).

The first tubular (202) includes a first inner diameter (ID) (208) and a first outer diameter (OD) (210). Any "OD", such as a "first OD", "second OD", etc., of the apparatus may also be known as a drift diameter. The first OD (210) is designed such that the first tubular (202) may drift a first diameter (118) or the largest diameter of two cylinders. In some embodiments, the first tubular (202) may include a first fishing neck (212) to be used for future retrieval. The second tubular (204) includes a second OD (214) and no second ID or a second ID equal to zero. The second OD (214) is designed such that the second tubular (204) may drift a second diameter (120) or the smallest diameter of two cylinders. In some embodiments, the second tubular (204) may be attached to a slickline (216) along an axis (106) to aid in translation of the apparatus during drifting. The first tubular (202) and the second tubular (204) may each be a rigid material such as steel or aluminum.

The apparatus in FIG. 2A is shown in a fully nested configuration where the second tubular (204) is fully nested into the first tubular (202). In some embodiments, the second tubular (204) may be concentrically nested, as shown in FIG. 2A, tangentially nested, or neither relative to the first tubular (202). For the second tubular (204) to nest into the first tubular (202), the second OD (214) of the second tubular (204) is smaller than the first ID (208) of the first tubular (202). The first plurality of attachments (206) couples the first ID (208) of the first tubular (202) and the second OD (214) of the second tubular (204). The apparatus may be in a fully nested configuration prior to drifting. The apparatus may also be in a fully nested configuration during drifting of the first diameter (118) or following drifting of the first diameter (118). In other embodiments, the apparatus may be in a partially nested configuration prior to drifting, during drifting of the first diameter (118), or during drifting of the second diameter (120).

FIG. 2B shows a side view of the apparatus of FIG. 2A in accordance with one or more embodiments. The apparatus still includes a first tubular (202), a second tubular (204), and a first plurality of attachments (206). The apparatus is shown in a partially nested configuration (hereinafter also "partially expanded configuration"). In some embodiments, the apparatus may be in a partially expanded configuration following drifting of the first diameter (118) and during drifting of the second diameter (120). Following drifting of the first diameter (118), the first tubular (202) contacts a first floor (130). In some embodiments, a jar (not shown) coupled to a slickline (216) may be fired or tripped such that the first plurality of attachments (206) is removed. The second tubular (204) is free to translate or telescope along the axis (106) to drift the second diameter (120) until the second tubular (204) contacts a second floor (132). In some embodiments, the first plurality of attachments (206) may be shear pins. Further, the jar may be a mechanical jar or a hydraulic jar.

Figure 3B:
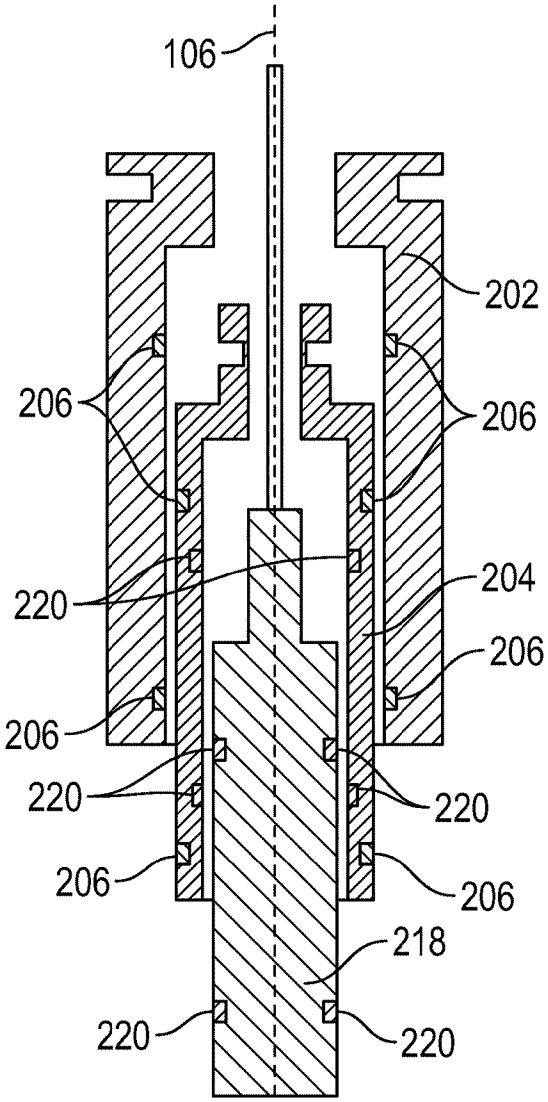
FIG. 3B shows a side view of a partially expanded apparatus in accordance with one or more embodiments.
Figure 3A:
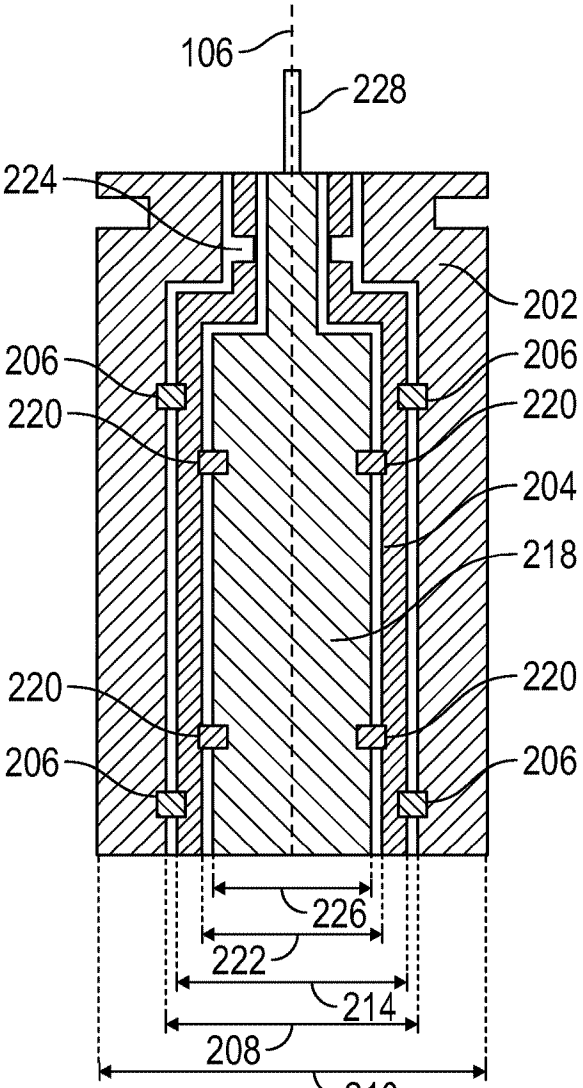
FIG. 3A shows a side view of a fully nested apparatus in accordance with one or more embodiments.

FIG. 3A shows a side view of an apparatus for drifting three cylindrical diameters in accordance with one or more embodiments. The apparatus allows for three cylindrical diameters to be drifted in series. The apparatus includes a first tubular (202), a second tubular (204), a third tubular (218), a first plurality of attachments (206), and a second plurality of attachments (220).

The first tubular (202) includes a first ID (208) and a first OD (210). The first OD (210) is designed such that the first tubular (202) may drift a first diameter (118) or the largest diameter of three cylinders. The second tubular (204) includes a second ID (222) and a second OD (214). The second OD (214) is designed such that the second tubular (204) may drift a second diameter (120) or the second largest diameter of three cylinders. In some embodiments, the second tubular (204) may include a second fishing neck (224) to be used for future retrieval. The third tubular (218) includes a third OD (226) and no third ID or a third ID equal to zero. The third OD (226) is designed such that the third tubular (218) may drift a third diameter (124) or the smallest diameter of three cylinders. In some embodiments, the third tubular (218) may be attached to a wireline (228) along an axis (106) to aid in translation of the apparatus during drifting. The third tubular (218) may be a rigid material such as steel or aluminum.

The apparatus is shown in a fully nested configuration where the third tubular (218) is fully nested into the second tubular (204) and the second tubular (204) is fully nested into the first tubular (202). In some embodiments, a nested pair of tubulars may be concentrically nested, as shown in FIG. 3A, tangentially nested, or neither. For the third tubular (218) to nest into the second tubular (204), the third OD (226) of the third tubular (218) is smaller than the second ID (222) of the second tubular (204). Further, for the second tubular (204) to nest into the first tubular (202), the second OD (214) of the second tubular (204) is smaller than the first ID (208) of the first tubular (202). The first plurality of attachments (206) couples the first ID (208) of the first tubular (202) and the second OD (214) of the second tubular (204). The second plurality of attachments (220) couples the second ID (222) of the second tubular (204) and the third OD (226) of the third tubular (218). The apparatus may be in a fully nested configuration prior to drifting. The apparatus may also be in a fully nested configuration during drifting of the first diameter (118).

FIG. 3B shows a side view of the apparatus of FIG. 3A in accordance with one or more embodiments. The apparatus still includes a first tubular (202), a second tubular (204), a third tubular (218), a first plurality of attachments (206), and a second plurality of attachments (220). The apparatus is shown in a partially nested configuration or partially expanded configuration. In some embodiments, the apparatus may be in a partially expanded configuration during drifting of the first diameter (118), the second diameter (120), and the third diameter (124).

Following drifting of the first diameter (118), the first tubular (202) contacts a first floor (130). In some embodiments, the first plurality of attachments (206) may be retractable pins that are retracted based on a digital signal. The coupled second tubular (204) and third tubular (218) may be translated along an axis to drift the second diameter (120) until the second tubular (204) contacts a second floor (132). In some embodiments, the second plurality of attachments (220) may be retractable pins that are retracted based on another digital signal. The third tubular (218) may be translated along an axis to drift the third diameter (124) until the third tubular (218) contacts the third floor (134). Once the first diameter (118) through the third diameter (124) are drifted, the apparatus may be in a fully expanded configuration where the first tubular (202) is in contact with the first floor (130); the second tubular (204), the second floor (132); and the third tubular (218), the third floor (134).

Figure 4:
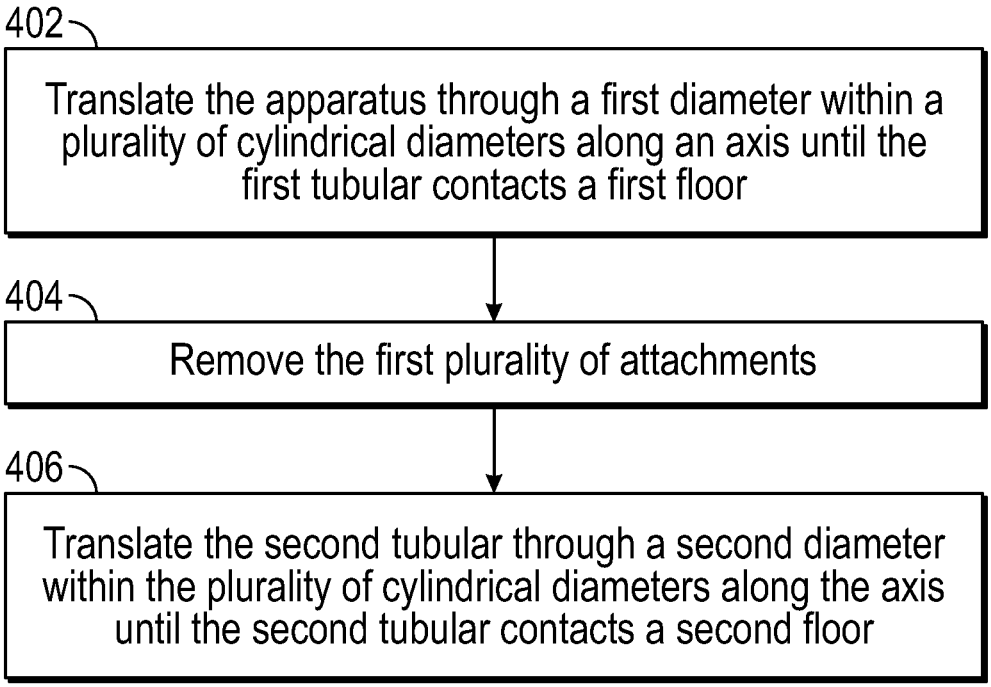
FIG. 4 shows a flowchart in accordance with one or more embodiments.

FIG. 4 shows a flowchart for drifting the apparatus for two cylindrical diameters in accordance with one or more embodiments. The apparatus allows for two diameters of cylinders to be drifted in series as the apparatus is translated through the cylinders once. In one or more embodiments, the apparatus is similar to the apparatus described in FIGS. 2A and 2B such that the apparatus includes a first tubular (202), a second tubular (204), and a first plurality of attachments (206) that couple the first ID (208) of the first tubular (202) and the second OD (214) of the second tubular (204).

Returning to FIG. 4, in step 402, the apparatus in a fully nested configuration or partially nested configuration is translated to drift a first diameter (118). The first tubular (202) may contact a first floor (130). In other embodiments, the first tubular (202) may get stuck within a cylinder. In step 404, the first plurality of attachments (206) is removed. Following removal of the first plurality of attachments (206), the second tubular (204) is free to translate or telescope along the axis (106) relative to the first tubular (202). In step 406, the free second tubular (204) is translated to drift a second diameter (120). The second tubular (204) may contact a second floor (132). In other embodiments, the second tubular (204) may get stuck within a cylinder. Once the apparatus has drifted both diameters of the cylinders, the apparatus may be in a fully expanded configuration.

Figure 5:
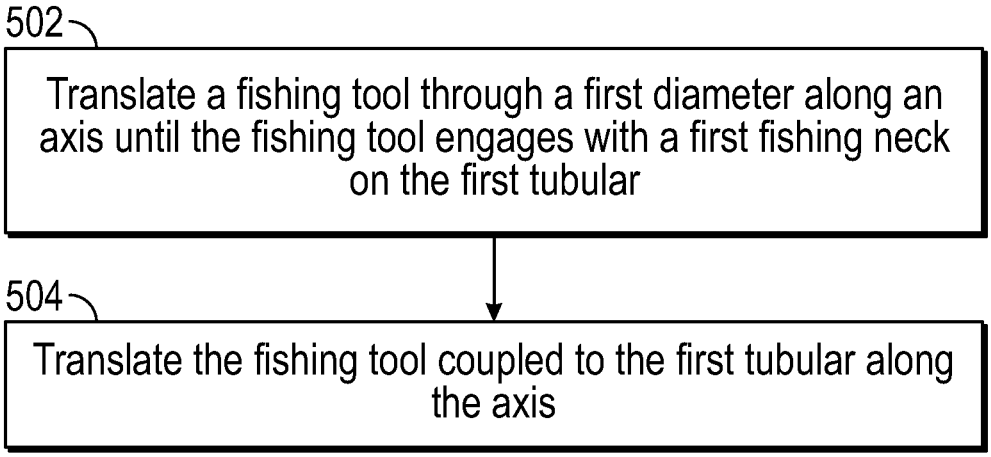
FIG. 5 shows a flowchart in accordance with one or more embodiments.

FIG. 5 shows a flowchart for retrieving a first tubular (202) following drifting in accordance with one or more embodiments. Assume the first tubular (202) and the second tubular (204) are decoupled. In some embodiments, the first tubular (202) may be in contact with a first floor (130). In other embodiments, the first tubular (202) may be stuck within a cylinder. In step 502, a fishing tool is translated through a first diameter (118) along an axis (106). The fishing tool engages with a first fishing neck (212) on the first tubular (202). In step 504, the fishing tool coupled to the first tubular (202) are translated along the axis (106). In some embodiments, the translating in steps 502 and 504 may be in opposing directions.

The disclosure presented herein describes an apparatus and method of drifting a plurality of cylindrical diameters in series where the cylinders may be tubulars or wellbores (100). The apparatus may be composed of two or more tubulars and one or more pluralities of attachments. The tubulars within the apparatus may be in a fully nested configuration or partially nested configuration prior to and during drifting. The tubulars within the apparatus may telescope or expand into a partially expanded configuration or fully expanded configuration as more diameters are drifted to expose tubulars of smaller outer diameters.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed is:

1. An apparatus for drifting a plurality of cylindrical diameters, the apparatus comprising:

a first tubular with a first inner diameter and a first outer diameter;

a second tubular with a second inner diameter and a second outer diameter, wherein the second outer diameter is smaller than the first inner diameter;

a first fishing neck on the second tubular;

a first plurality of attachments that couples the first inner diameter of the first tubular and the second outer diameter of the second tubular, wherein the first plurality of attachments is removeable to allow the second tubular to translate along an axis relative to the first tubular;

a third tubular with a third inner diameter and a third outer diameter, wherein the third outer diameter is smaller than the second inner diameter; and a second plurality of attachments that couples the second inner diameter of the second tubular and the third outer diameter of the third tubular, wherein the second plurality of attachments is removeable to allow the third tubular to translate along the axis relative to the second tubular.

2. The apparatus of claim 1, further comprising a second fishing neck on the first tubular.

3. The apparatus of claim 1, wherein the first tubular and the second tubular are nested.

4. The apparatus of claim 1, wherein the first outer diameter is smaller than a first diameter within the plurality of cylindrical diameters.

5. The apparatus of claim 1, wherein the second outer diameter is smaller than a second diameter within the plurality of cylindrical diameters.

6. The apparatus of claim 1, wherein the first tubular and the second tubular are each comprised of a rigid material.

7. The apparatus of claim 1, wherein the second tubular is coupled to a slickline.

8. The apparatus of claim 7, wherein ajar is coupled to the slickline.

9. The apparatus of claim 1, wherein the first plurality of attachments comprises shear pins.

10. The apparatus of claim 1, wherein the third inner diameter is zero.

11. The apparatus of claim 1, wherein the second tubular and the third tubular are nested.

12. The apparatus of claim 1, wherein the third outer diameter is smaller than a third diameter within the plurality of cylindrical diameters.

13. The apparatus of claim 1, wherein the third tubular is coupled to a slickline.

14. A method of drifting an apparatus for a plurality of cylindrical diameters, wherein the apparatus has a first tubular, a second tubular, a third tubular, a first plurality of attachments that couples a first inner diameter of the first tubular and a second outer diameter of the second tubular, a second plurality of attachments that couples a second inner diameter of the second tubular and a third outer diameter of the third tubular, and a first fishing neck on the second tubular, the method comprising:

translating the apparatus through a first diameter within the plurality of cylindrical diameters along an axis until the first tubular contacts a first floor;

removing the first plurality of attachments;

translating the second tubular through a second diameter within the plurality of cylindrical diameters along the axis until the second tubular contacts a second floor;

removing the second plurality of attachments;

translating the third tubular through a third diameter within the plurality of cylindrical diameters along the axis until the third tubular contacts a third floor; and translating a fishing tool through the first diameter and the second diameter until the fishing tool engages with the first fishing neck.

15. The method of claim 14, wherein a first outer diameter of the first tubular is smaller than the first diameter.

16. The method of claim 14, wherein the second outer diameter of the second tubular is smaller than the second diameter.

* * * * *